US011041137B2

(12) United States Patent
Chen et al.

(10) Patent No.: US 11,041,137 B2
(45) Date of Patent: Jun. 22, 2021

(54) LUBRICANT COMPOSITION COMPRISING HYDROXYCARBOXYLIC ACID DERIVED FRICTION MODIFIER

(71) Applicant: CRODA, INC., Edison, NJ (US)

(72) Inventors: Xin Chen, Hockessin, DE (US); Alexei Nikolaevich Kurchan, Wallingford, PA (US)

(73) Assignee: Croda, Inc., Plainsboro, NJ (US)

( * ) Notice: Subject to any disclaimer, the term of this patent is extended or adjusted under 35 U.S.C. 154(b) by 0 days.

(21) Appl. No.: 15/031,898

(22) PCT Filed: Oct. 23, 2014

(86) PCT No.: PCT/US2014/061964

§ 371 (c)(1),
(2) Date: Apr. 25, 2016

(87) PCT Pub. No.: WO2015/065801

PCT Pub. Date: May 7, 2015

(65) Prior Publication Data

US 2016/0264907 A1 Sep. 15, 2016

Related U.S. Application Data

(60) Provisional application No. 61/896,990, filed on Oct. 29, 2013.

(51) Int. Cl.

| | |
|---|---|
| ***C10M 159/22*** | (2006.01) |
| ***B01J 19/06*** | (2006.01) |
| ***C10M 169/04*** | (2006.01) |
| ***C10M 129/76*** | (2006.01) |
| ***C10M 145/38*** | (2006.01) |
| ***C10M 159/12*** | (2006.01) |
| *C10N 30/06* | (2006.01) |
| *C10N 40/04* | (2006.01) |
| *C10N 40/22* | (2006.01) |
| *C10N 40/25* | (2006.01) |

(52) U.S. Cl.

CPC ..... *C10M 169/042* (2013.01); *C10M 129/76* (2013.01); *C10M 145/38* (2013.01); *C10M 159/12* (2013.01); *C10M 2203/1025* (2013.01); *C10M 2207/283* (2013.01); *C10M 2207/289* (2013.01); *C10M 2209/102* (2013.01); *C10M 2209/109* (2013.01); *C10N 2030/06* (2013.01); *C10N 2040/04* (2013.01); *C10N 2040/22* (2013.01); *C10N 2040/25* (2013.01)

(58) Field of Classification Search

CPC ..... C10M 129/70; C10M 129/72; C10M 169/042; C10M 129/76; C10M 145/38; C10M 159/12; C10M 2209/109; C10M 2203/1025; C10M 2207/283; C10M 2207/289; C10M 2209/102; C10N 2030/06; C10N 2040/04; C10N 2040/22; C10N 2040/25

USPC ..... 508/575

See application file for complete search history.

(56) References Cited

U.S. PATENT DOCUMENTS

| | | | | |
|---|---|---|---|---|
| 4,153,770 | A | 5/1979 | Ogata | |
| 4,203,877 | A | 5/1980 | Baker | |
| 4,687,843 | A | 8/1987 | Smolin | |
| 8,404,625 | B2 | 3/2013 | Barton et al. | |
| 9,051,529 | B2 | 6/2015 | Kocsis et al. | |
| 9,315,621 | B2 | 4/2016 | Chen et al. | |
| 9,499,763 | B2 | 11/2016 | Loper et al. | |
| 2003/0153787 | A1 | 8/2003 | Carpenter | |
| 2004/0248747 | A1* | 12/2004 | Mayhew | C10M 141/02 508/527 |
| 2007/0299228 | A1 | 12/2007 | McNamee | |
| 2008/0090746 | A1 | 4/2008 | Penninger | |

(Continued)

FOREIGN PATENT DOCUMENTS

| | | | |
|---|---|---|---|
| CN | 101402896 | A | 4/2009 |
| CN | 102459542 | A | 5/2012 |

(Continued)

OTHER PUBLICATIONS

International Search Report and Written Opinion of the International Searching Authority for International Application No. PCT/US2014/061964 dated Jan. 26, 2015.

International Preliminary Report on Patentability issued in related International Application No. PCT/US2014/061964, dated May 3, 2016. 2016.

(Continued)

*Primary Examiner* — Prem C Singh
*Assistant Examiner* — Francis C Campanell
(74) *Attorney, Agent, or Firm* — RatnerPrestia

(57) ABSTRACT

The present invention relates to a lubricant composition containing a base stock and at least 0.01 wt % of a friction reducing additive which is a compound of the Formula (I):

$$R^1[(AO)_n—R^2]_m \quad (I)$$

wherein $R^1$ is the residue of a group having at least 2 active hydrogen atoms; m is at least 2; AO is an alkylene oxide residue; each n is independently from 0 to 100; and each $R^2$ is independently H or $R^3$, where each $R^3$ is independently a residue of a polyhydroxyalkyl or polyhydroxyalkenyl carboxylic acid, a residue of a hydroxyalkyl or hydroxyalkenyl carboxylic acid and/or a residue of an oligomer of the hydroxyalkyl or hydroxyalkenyl carboxylic acid; and on average at least 0.5 of $R^2$ groups are $R^3$. The lubricant composition is suitable for use in an engine oil, a hydraulic oil or fluid, a gear oil and/or a metal-working fluid.

20 Claims, No Drawings

(56) References Cited

U.S. PATENT DOCUMENTS

| | | | | |
|---|---|---|---|---|
| 2008/0269087 | A1* | 10/2008 | Psaila | C10M 125/10 508/171 |
| 2009/0093385 | A1 | 4/2009 | Dowding et al. | |
| 2010/0113312 | A1* | 5/2010 | Ward | C10M 125/26 508/158 |
| 2011/0059877 | A1 | 3/2011 | Obiols et al. | |
| 2011/0294707 | A1* | 12/2011 | Abraham | C10M 137/06 508/273 |
| 2012/0161065 | A1 | 6/2012 | Wei | |
| 2015/0191672 | A1 | 7/2015 | Hanyuda et al. | |

FOREIGN PATENT DOCUMENTS

| | | | |
|---|---|---|---|
| CN | 102575184 | A | 7/2012 |
| CN | 102918065 | A | 2/2013 |
| EP | 0000424 | | 1/1979 |
| EP | 1344518 | | 9/2003 |
| EP | 1367118 | | 12/2003 |
| EP | 2546325 | A1 | 1/2013 |
| EP | 2746372 | | 6/2014 |
| GB | 514461 | | 11/1939 |
| JP | 2000210504 | | 8/2000 |
| JP | 2005041819 | | 2/2005 |
| JP | 2011505484 | A | 2/2011 |
| JP | 2011184661 | A | 9/2011 |
| JP | 2014025040 | A | 2/2014 |
| JP | 2014132076 | A | 7/2014 |
| WO | 9855088 | | 12/1998 |
| WO | 03033634 | | 4/2003 |
| WO | 2005059042 | A2 | 6/2005 |
| WO | 2011022317 | | 2/2011 |
| WO | 2011107739 | | 9/2011 |
| WO | 2011116049 | | 9/2011 |
| WO | 2012056191 | | 5/2012 |

OTHER PUBLICATIONS

Chinese Office Action for Chinese Application No. 201480059593.7, dated Mar. 28, 2018, including English translation, 16 pages.

* cited by examiner

LUBRICANT COMPOSITION COMPRISING HYDROXYCARBOXYLIC ACID DERIVED FRICTION MODIFIER

CROSS REFERENCE TO RELATED APPLICATIONS

This application is the National Stage filing of International Appln. No. PCT/US2014/061964, filed 23 Oct. 2014, which itself claims priority of U.S. Provisional Patent Application No. 61/896,990, filed 29 Oct. 2013, the entirety of which applications is incorporated herein by reference for all purposes.

FIELD OF INVENTION

The present invention relates to a lubricant composition comprising a base stock and a friction reducing additive. The lubricant composition may be used as an engine oil, a hydraulic oil or fluid, a gear oil and/or a metal-working fluid. The invention also relates to the use of the friction reducing additive and a method of reducing friction.

BACKGROUND

Friction reducing additives that have been used to improve fuel economy in automotive engine oils fall into three main chemically-defined categories, which are organic, metal organic and oil insoluble. The organic friction-reducing additives themselves fall within four main categories which are carboxylic acids or their derivatives, nitrogen-containing compounds such as amides, imides, amines and their derivatives, phosphoric or phosphonic acid derivatives and organic polymers.

Automotive engine oils typically comprise a lubricant base stock and an additive package, both of which can contribute significantly to the properties and performance of the automotive engine oil.

The choice of lubricant base stock can have a major impact on properties such as oxidation and thermal stability, volatility, low temperature fluidity, solvency of additives, contaminants and degradation products, and traction. The American Petroleum Institute (API) currently defines five groups of lubricant base stocks (API Publication 1509).

Groups I, II and III are mineral oils which are classified by the amount of saturates and sulphur they contain and by their viscosity indices. Table 1 below illustrates these API classifications for Groups I, II and III.

TABLE 1

| Group | Saturates | Sulphur | Viscosity Index (VI) |
|---|---|---|---|
| I | <90% | >0.03% | 80-120 |
| II | At least 90% | Not more than 0.03% | 80-120 |
| III | At least 90% | Not more than 0.03% | At least 120 |

Group I base stocks are solvent refined mineral oils, which are the least expensive base stock to produce, and currently account for the majority of base stock sales. They provide satisfactory oxidation stability, volatility, low temperature performance and traction properties and have very good solvency for additives and contaminants. Group II base stocks are mostly hydroprocessed mineral oils, which typically provide improved volatility and oxidation stability as compared to Group I base stocks. The use of Group II stocks has grown to about 30% of the US market. Group III base stocks are severely hydroprocessed mineral oils or they can be produced via wax or paraffin isomerisation. They are known to have better oxidation stability and volatility than Group I and II base stocks but have a limited range of commercially available viscosities.

Group IV base stocks differ from Groups I to III in that they are synthetic base stocks e.g. polyalphaolefins (PAOs). PAOs have good oxidative stability, volatility and low pour points. Disadvantages include moderate solubility of polar additives, for example antiwear additives.

Group V base stocks are all base stocks that are not included in Groups I to IV. Examples include alkyl naphthalenes, alkyl aromatics, vegetable oils, esters (including polyol esters, diesters and monoesters), polycarbonates, silicone oils and polyalkylene glycols.

To create a suitable engine oil, additives are blended into the chosen base stock. The additives either enhance the stability of the lubricant base stock or provide additional protection to the engine. Examples of engine oil additives include antioxidants, antiwear agents, detergents, dispersants, viscosity index improvers, defoamers, pour point depressants and friction reducing additives.

One area of concern for automotive engines is around reduction of fuel consumption and increasing energy efficiency. It is well known that the automotive engine oil has a significant part to play in the overall energy consumption of automotive engines. Automotive engines can be thought of as consisting of three discreet but connected mechanical assemblies which together make up the engine, the valve train, the piston assembly, and the bearings. Energy losses in mechanical components can be analysed according to the nature of the friction regime after the well-known Stribeck curve. Predominant losses in the valve train are boundary and elastohydrodynamic, in the bearings are hydrodynamic, and the pistons hydrodynamic and boundary. Hydrodynamic losses have been gradually improved by the reduction of automotive engine oil viscosity. Elastohydrodynamic losses can be improved by selection of the base stock type, taking into account the traction coefficient of the base stock. Boundary losses can be improved by careful selection of a friction reducing additive.

SUMMARY OF THE INVENTION

We have now surprisingly discovered a lubricant composition which overcomes or significantly reduces at least one of the aforementioned problems.

Accordingly, the present invention provides a lubricant composition comprising a base stock and at least 0.01 wt % of a friction reducing additive which comprises a compound of the Formula (I):

$$R^1[(AO)_n—R^2]_m \quad (I)$$

wherein:

$R^1$ is the residue of a group having at least 2 active hydrogen atoms;

m is at least 2;

AO is an alkylene oxide residue;

each n is independently from 0 to 100; and each $R^2$ is independently H or $R^3$, where each $R^3$ is independently a residue of a polyhydroxyalkyl or polyhydroxyalkenyl carboxylic acid, a residue of a hydroxyalkyl or hydroxyalkenyl carboxylic acid and/or a residue of an oligomer of the hydroxyalkyl or hydroxyalkenyl carboxylic acid; and on average at least 0.5 of $R^2$ groups are $R^3$.

The present invention also provides a method of reducing friction in an engine which comprises using an engine oil comprising a base stock and at least 0.01 wt % of a friction reducing additive which comprises a compound of the Formula (I):

$$R^1[(AO)_n—R^2]_m \quad (I)$$

wherein:

$R^1$ is the residue of a group having at least 2 active hydrogen atoms;

m is at least 2;

AO is an alkylene oxide residue;

each n is independently from 0 to 100; and each $R^2$ is independently H or $R^3$, where each $R^3$ is independently a residue of a polyhydroxyalkyl or polyhydroxyalkenyl carboxylic acid, a residue of a hydroxyalkyl or hydroxyalkenyl carboxylic acid and/or a residue of an oligomer of the hydroxyalkyl or hydroxyalkenyl carboxylic acid; and on average at least 0.5 of $R^2$ groups are $R^3$.

The present invention further provides the use of a compound of the Formula (I):

$$R^1[(AO)_n—R^2]_m \quad (I)$$

wherein:

$R^1$ is the residue of a group having at least 2 active hydrogen atoms;

m is at least 2;

AO is an alkylene oxide residue;

each n is independently from 0 to 100; and each $R^2$ is independently H or $R^3$, where each $R^3$ is independently a residue of a polyhydroxyalkyl or polyhydroxyalkenyl carboxylic acid, a residue of a hydroxyalkyl or hydroxyalkenyl carboxylic acid and/or a residue of an oligomer of the hydroxyalkyl or hydroxyalkenyl carboxylic acid; and on average at least 0.5 of $R^2$ groups are $R^3$, to reduce the co-efficient of friction of a lubricant composition.

The friction reducing additive described herein may advantageously improve the performance of the lubricant composition by reducing friction losses in a system to which the lubricant composition is applied.

The friction reducing additive described herein can be used as a friction reducing additive in engine oils and in particular in automotive engine oils, automotive gear and transmission oils, industrial gear oils, hydraulic oils, compressor oils, turbine oils, cutting oils, rolling oils, drilling oils, lubricating greases and the like.

The friction reducing additive comprises or consists of a compound or composition of the Formula (I):

$$R^1[(AO)_n—R^2]_m \quad (I)$$

wherein:

$R^1$ is the residue of a group having at least 2 active hydrogen atoms;

m is at least 2;

AO is an alkylene oxide residue;

each n is independently from 0 to 100; and each $R^2$ is independently H or $R^3$, where each $R^3$ is independently a residue of a polyhydroxyalkyl or polyhydroxyalkenyl carboxylic acid, a residue of a hydroxyalkyl or hydroxyalkenyl carboxylic acid and/or a residue of an oligomer of the hydroxyalkyl or hydroxyalkenyl carboxylic acid; and on average at least 0.5 of $R^2$ groups are $R^3$.

The friction reducing additive is at least notionally built up from the group $R^1$ that can be considered as the "core group" of the compound. This core group is the residue (after removal of m active hydrogen atoms) of a compound containing at least 2 active hydrogen atoms, preferably present in hydroxyl and/or amino groups, and more preferably present in hydroxyl groups only. Preferably the core group is the residue of a substituted hydrocarbyl group, particularly a $C_3$ to $C_{30}$ substituted hydrocarbyl compound.

Examples of $R^1$ core groups include the residues of the following compounds after removal of m active hydrogen atoms:

1 glycerol and the polyglycerols, especially diglycerol and triglycerol, the partial esters thereof, or any triglycerides containing multiple hydroxyl groups, for example castor oil;

2 tri- and higher polymethylol alkanes such as trimethylol ethane, trimethylol propane and pentaerythritol, and the partial esters thereof;

3 sugars, particularly non-reducing sugars such as sorbitol, mannitol, and lactitol, etherified derivatives of sugars such as sorbitan (the cyclic dehydro-ethers of sorbitol), partial alkyl acetals of sugars such as methyl glucose and alkyl (poly-) saccharides, and other oligo-/poly-mers of sugars such as dextrins, partially esterified derivatives of sugars, such as fatty acid esters, for example of lauric, palmitic, oleic, stearic and behenic acid, esters of sorbitan, sorbitol, and sucrose, aminosaccharides such as N-alkylglucamines and their respective N-alkyl-N-alkenoyl glucamides;

4 polyhydroxy carboxylic acids especially citric and tartaric acids;

5 amines including di- and poly-functional amines, particularly alkylamines including alkyl diamines such as ethylene diamine (1,2-diaminoethane);

6 amino-alcohols, particularly the ethanolamines, 2-aminoethanol, di-ethanolamine and triethanolamine;

7 carboxylic acid amides such as urea, malonamide and succinamide; and 8 amido carboxylic acids such as succinamic acid.

Preferred $R^1$ core groups are residues of groups having at least three, more preferably in the range from 4 to 10, particularly 5 to 8, and especially 6 free hydroxyl and/or amino groups. The $R^1$ group preferably has a linear $C_4$ to $C_7$, more preferably $C_6$ chain. The hydroxyl or amino groups are preferably directly bonded to the chain carbon atoms. Hydroxyl groups are preferred.

$R^1$ is preferably the residue of an open chain tetratol, pentitol, hexitol or heptitol group or an anhydro, e.g. cycloether anhydro, derivative of such a group. In a particularly preferred embodiment, $R^1$ is the residue of, or a residue derived from, a sugar, more preferably a monosaccharide such as glucose, fructose or sorbitol, a disaccharide such as maltose, palitose, lactitol or lactose or a higher oligosaccharide. $R^1$ is preferably the residue of a monosaccharide, more preferably of glucose, fructose or sorbitol, and particularly of sorbitol.

The open chain form of $R^1$ groups is preferred, however groups including internal cyclic ether functionality can be used, and may be obtained inadvertently if the synthetic route exposes the group to relatively high temperatures or other conditions, which promote such cyclisation.

The index m is a measure of the functionality of the $R^1$ core group and the alkoxylation reactions will replace some or all of the active hydrogen atoms (dependent on the molar ratio of core group to alkoxylation group) in the molecule from which the core group is derived. Reaction at a particular site may be restricted or prevented by steric hindrance or suitable protection. The terminating hydroxyl groups of the polyalkylene oxide chains in the resulting compounds are then available for reaction with the above defined acyl compounds. The index m will preferably be at least 3, more preferably in the range from 4 to 10, particularly 5 to 8, and especially 5 to 6. Mixtures may be, and normally are, employed, and therefore m can be an average value and may be non-integral.

The alkylene oxide groups AO are typically groups of the formula: —($C_rH_{2r}O$)— where r is 2, 3 or 4, preferably 2 or 3, i.e. an ethyleneoxy (—$C_2H_4O$—) or propyleneoxy (—$C_3H_6O$—) group, and it may represent different groups along the alkylene oxide chain. Generally, it is desirable that the chain is a homopolymeric ethylene oxide chain. However, the chain may be a homopolymer chain of propylene glycol residues or a block or random copolymer chain containing both ethylene glycol and propylene glycol residues. Usually, where co-polymeric chains of ethylene and propylene oxide units are used the molar proportion of ethylene oxide units used will be at least 50% and more usually at least 70%.

The number of alkylene oxide residues in the (poly) alkylene oxide chains, i.e. the average value of the parameter n, will suitably be in the range from 1 to 50, preferably 2 to 20, more preferably 4 to 15, particularly 7 to 10, and especially 8 to 9. The total of the indices n, or the product of indices n×m, is suitably in the range from 5 to 300, preferably 10 to 100, more preferably 25 to 65, particularly 40 to 60, and especially 45 to 55. The value of the index n is an average value, which includes statistical variation in the chain length.

The groups $R^2$ are the "terminating groups" of the (poly) alkylene oxide chains. The terminating groups are hydrogen or $R^3$, where each $R^3$ is independently a residue of a polyhydroxyalkyl or polyhydroxyalkenyl carboxylic acid, a residue of a hydroxyalkyl carboxylic acid or hydroxyalkenyl carboxylic acid and/or a residue of an oligomer of the hydroxyalkyl or hydroxyalkenyl carboxylic acid. Preferably each $R^3$ is independently a residue of a polyhydroxyalkyl carboxylic acid, a residue of a hydroxyalkyl carboxylic acid and/or a residue of an oligomer of the hydroxyalkyl carboxylic acid, more preferably a residue of a polyhydroxyalkyl carboxylic acid.

On average, suitably at least 1.0, preferably at least 1.5, more preferably at least 2.0, particularly at least 2.2, and especially at least 2.4 of the $R^2$ groups are $R^3$. In addition, on average suitably up to 6.0, preferably up to 4.0, more preferably up to 3.0, particularly up to 2.7, and especially up to 2.5 of the $R^2$ groups are $R^3$.

The hydroxylalkyl and hydroxyalkenyl carboxylic acids are of formula HO—X—COOH where X is a divalent saturated or unsaturated, preferably saturated, aliphatic radical containing at least 8 carbon atoms and no more than 20 carbon atoms, typically from 11 to 17 carbons and in which there are at least 4 carbon atoms directly between the hydroxyl and carboxylic acid groups.

Desirably the hydroxyalkyl carboxylic acid is 12-hydroxystearic acid. In practice such hydroxyalkyl carboxylic acids are commercially available as mixtures of the hydroxyl acid and the corresponding unsubstituted fatty acid. For example 12-hydroxystearic acid is typically manufactured by hydrogenation of castor oil fatty acids including the C18 unsaturated hydroxyl acid and the non-substituted fatty acids (oleic and linoleic acids) which on hydrogenation gives a mixture of 12-hydroxystearic and stearic acids. Commercially available 12-hydroxystearic acid typically contains about 5 to 8% of unsubstituted stearic acid.

The polyhydroxyalkyl or polyhydroxyalkenyl carboxylic acid may be manufactured by polymerising the above hydroxyalkyl or hydroxyalkenyl carboxylic acid. The presence of the corresponding unsubstituted fatty acid acts as a terminating agent and therefore limits the chain length of the polymer. Desirably the number of hydroxyalkyl or hydroxyalkenyl units is on average from 2 to 12, preferably from 3 to 10, more preferably from 4 to 9, particularly from 5 to 8, and especially 6 to 7. The molecular weight of the polyacid is typically from 600 to 3,000, particularly from 900 to 2,700, more particularly from 1,500 to 2,400 and especially about 2,100.

The residual acid value for the polyhydroxyalkyl or polyhydroxyalkenyl carboxylic acid typically is less than 50 mgKOH/g and a preferable range is 30 to 35 mgKOH/g. Typically the hydroxyl value for the polyhydroxyalkyl or polyhydroxyalkenyl carboxylic acid is a maximum of 40 mgKOH/g and a preferable range is 20 to 30 mgKOH/g.

The oligomer of the hydroxyalkyl or hydroxyalkenyl carboxylic acid may differ from the polymer in that termination is not by the unsubstituted corresponding fatty acid. Desirably it is a dimer of the hydroxylalkyl or hydroxyalkenyl carboxylic acid.

In one preferred embodiment, on average suitably at least 1.0, preferably at least 1.5, more preferably at least 2.0, particularly at least 2.3, and especially at least 2.4 of the $R^2$ groups are $R^3$ groups which are polyhydroxyalkyl carboxylic acid residues. In addition, on average suitably up to 4.0, preferably up to 3.5, more preferably up to 3.0, particularly up to 2.7, and especially up to 2.5 of the $R^2$ groups are $R^3$ groups which are polyhydroxyalkyl carboxylic acid residues. These polyhydroxyalkyl carboxylic acid residues suitably contain on average from 3 to 10, preferably from 4 to 9, more preferably from 5 to 8, particularly from 6 to 7, and especially 7 hydroxyalkyl monomer units.

The polyhydroxyalkyl carboxylic acid residues are preferably terminated with an unsubstituted carboxylic acid, more preferably with stearic acid.

In another preferred embodiment, when the $R^3$ groups comprise hydroxyalkyl carboxylic acid residues, preferably polyhydroxyalkyl carboxylic acid residues, the total number of all of the hydroxyalkyl carboxylic acid residues present in the compound of Formula (I) defined herein is suitably on average in the range from 5 to 30, preferably 8 to 20, more preferably 10 to 17, particularly 12 to 15, and especially 13 to 14 hydroxyalkyl monomer units.

In a further preferred embodiment, on average suitably at least 2.0, preferably at least 2.5, more preferably at least 3.0, particularly at least 3.3, and especially at least 3.5 of the $R^2$ groups are H. In addition, on average suitably up to 5.0, preferably up to 4.5, more preferably up to 4.0, particularly up to 3.7, and especially up 3.6 of the $R^2$ groups are H.

When the core group is derived from, for example, pentaerythritol, alkoxylation of the core residue may be evenly distributed over the four available sites from which an active hydrogen can be removed and on esterification of the terminal hydroxyl functions the distribution of acyl groups will be close to the expected random distribution. However, when the core group is derived from compounds, such as sorbitol, where all of the active hydrogen atoms are not equivalent, alkoxylation may give unequal chain lengths for the polyalkyleneoxy chains.

The friction reducing additive can be made by firstly alkoxylating $R^1$ core groups containing m active hydrogen atoms, by techniques well known in the art, for example by reacting with the required amounts of alkylene oxide, for example ethylene oxide and/or propylene oxide. The second stage of the process preferably comprises reacting the aforementioned alkoxylated species with a polyhydroxyalkyl (alkenyl) carboxylic acid and/or a hydroxyalkyl(alkenyl) carboxylic acid under standard catalysed esterification conditions at temperatures up to 250° C.

Thus, the friction reducing additive of Formula (I) can be produced by reacting the group $R^1$ with alkylene oxide and then esterifying the alkoxylated product of this reaction with a polyhydroxyalkyl (alkenyl) carboxylic acid, a hydroxyalkyl(alkenyl) carboxylic acid, or a mixture thereof.

In one preferred embodiment, the friction reducing additive is prepared by reaction of the alkoxylated core group $R^1$ with a polyhydroxyalkyl carboxylic acid where the molar ratio of alkoxylated core group to polyacid preferably ranges from 1:1 to 1:4, more preferably from 1:2 to 1:2.8. Preferably the friction reducing additive prepared by this route has a molecular weight (Mn) between 3,000 to 10,000, more preferably 4,000 to 7000, and particularly 5,000 to 6,000.

The lubricant composition of the present invention comprises a base stock. The lubricant composition may comprise at least 50 wt %, preferably at least 60 wt %, more preferably at least 70 wt %, even more preferably least 80 wt % of base stock based on the total weight of the composition. The lubricant composition may comprise up to 98 wt %, preferably up to 95 wt %, more preferably up to 90 wt % base stock based on the total weight of the composition.

The lubricant composition may comprise at least 0.02 wt %, suitably at least 0.05 wt %, preferably at least 0.1 wt %, more preferably at least 0.5 wt %, even more preferably at least 1 wt % of the friction reducing additive based on the total weight of the composition. The lubricant composition may comprise at least 5 wt %, or even at least 10 wt % of the friction reducing additive. The lubricant composition may comprise up to 20 wt %, preferably up to 15 wt % of the friction reducing additive based on the total weight of the composition.

In one embodiment, the lubricant composition is non-aqueous. However, it will be appreciated that components of the lubricant composition may contain small amounts of residual water (moisture) which may therefore be present in the lubricant composition. The lubricant composition may comprise less than 5% water by weight based on the total weight of the composition. More preferably, the lubricant composition is substantially water free, i.e. contains less than 2%, less than 1%, or preferably less that 0.5% water by weight based on the total weight of the composition. Preferably the lubricant composition is substantially anhydrous.

The lubricant composition may be an engine oil, hydraulic oil or fluid, gear oil or metal working fluid. To adapt the lubricant composition to its intended use, the lubricant composition may comprise one or more of the following further additive types.

1. Dispersants: for example, alkenyl succinimides, alkenyl succinate esters, alkenyl succinimides modified with other organic compounds, alkenyl succinimides modified by post-treatment with ethylene carbonate or boric acid, pentaerythritols, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants.

2. Anti-oxidants: Anti-oxidants reduce the tendency of mineral oils to deteriorate in service which deterioration is evidenced by the products of oxidation such as sludge and varnish-like deposits on the metal surfaces and by an increase in viscosity. Examples of anti-oxidants include phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butyl-phenol), 4,4'-butylidene-bis(3-methyl-6-tert-butylphenol), 4,4'-isopropylidene-bis(2,6-di-tert-butylphenol), 2,2'-methylene-bis(4-me-thyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,6-di-tert-butylphenol, 2,4-dimethyl-6-tert-butyl-phenol, 2,6-di-tert-l-dimethylamino-p-cresol, 2,6-di-tert-4-(N,N'-dimethylamino-methylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxy-benzyl). Other types of oxidation inhibitors include alkylated diphenylamines (e.g., Irganox L-57 from Ciba-Geigy), metal dithiocarbamate (e.g., zinc dithiocarbamate), and methylenebis(dibutyldithiocarbamate).

3. Antiwear agents: As their name implies, these agents reduce wear of moving metallic parts. Examples of such agents include phosphates, phosphites, carbamates, esters, sulfur containing compounds, and molybdenum complexes.

4. Emulsifiers: for example, linear alcohol ethoxylates.

5. Demulsifiers: for example, addition products of alkylphenol and ethylene oxide, polyoxyethylene alkyl ethers, and polyoxyethylene sorbitan esters.

6. Extreme pressure agents (EP agents): for example, zinc dialkyldithiophosphate (primary alkyl, secondary alkyl, and aryl type), sulfurized oils, diphenyl sulfide, methyl trichlorostearate, chlorinated naphthalene, fluoroalkylpolysiloxane, and lead naphthenate. A preferred EP agent is zinc dialkyl dithiophosphate (ZnDTP), e.g. as one of the co-additive components for an antiwear hydraulic fluid composition.

7. Multifunctional additives: for example, sulfurized oxymolybdenum dithiocarbamate, sulfurized oxymolybdenum organo phosphorodithioate, oxymolybdenum monoglycehde, oxymolybdenum diethylate amide, amine-molybdenum complex compound, and sulfur-containing molybdenum complex compound.

8. Viscosity index improvers: for example, polymethacrylate polymers, ethylene-propylene copolymers, styrene-isoprene copolymers, hydrogenated styrene-isoprene copolymers, polyisobutylene, and dispersant type viscosity index improvers.

9. Pour point depressants: for example, polymethacrylate polymers.

10. Foam inhibitors: for example, alkyl methacrylate polymers and dimethyl silicone polymers.

The lubricant composition may comprise at least 0.5 wt % of a further additive or a mixture of further additives, preferably at least 1 wt %, more preferably at least 5 wt % based on the total weight of the composition. The lubricant composition may comprise up to 30 wt % of a further additive or a mixture of further additives, preferably up to 20 wt %, more preferably up to 10 wt % based on the total weight of the composition.

The additive or additives may be available in the form of a commercially available additive pack. Such additive packs vary in composition depending on the required use of the additive pack. A skilled person may select a suitable commercially available additive pack for each of: an engine oil, a gear oil, a hydraulic fluid and a metal working fluid. An example of a suitable additive pack for an engine oil is Hitec 11100 ex. Afton Chemical Corporation, US which is recommended to be used at about 10 wt % of the lubricant composition. An example of a suitable additive pack for a gear oil is Additin RC 9451 ex. Rhein Chemie Rheinau GmbH, Germany which is recommended to be used at between 1.5 to 3.5 wt % of the lubricant composition. An example of a suitable additive pack for a hydraulic oil or fluid is Additin RC 9207 ex. Rhein Chemie Rheinau GmbH, Germany which is recommended to be used at about 0.85 wt % of the lubricant composition. An example of a suitable additive pack for a metal working fluid is Additin RC 9410 ex. Rhein Chemie Rheinau GmbH, Germany which is recommended to be used at between 2 to 7 wt % of the lubricant composition.

In this specification, base stock Group nomenclatures as defined by the American Petroleum Institute (API) will be used. The base stock may be selected based on the intended use of the lubricant composition.

Preferably the base stock is selected from the group consisting of an API Group I, II, III, IV, V base stock or mixtures thereof. If the base stock includes a polyalphaolefin (PAO) from Group IV then the base stock may also include a mineral oil from Group I, II or III or an ester from Group V to improve the solubility of the friction reducing additive in the base stock. The ester from Group V may be present at between 5 to 10 wt % of the lubricant composition to improve the solubility of the friction reducing additive in the base stock. The base stock may be a mixture of Group IV and Group V base stocks or Group IV and Group I, II or III base stocks.

In one embodiment, the lubricant composition of the present invention is used as an engine oil, preferably an automotive engine oil. When the lubricant composition is an engine oil, the friction reducing additive is preferably present at a concentration in the range from 0.1 to 10 wt % based on the total weight of the engine oil.

For an automotive engine oil the term base stock includes both gasoline and diesel (including heavy duty diesel (HD-DEO)) engine oils. The base stock may be chosen from any of the Group I to Group V base oils (which includes Group III+ gas to liquid) or a mixture thereof. Preferably the base stock has one of Group II, Group III or a Group IV base oil as its major component, especially Group III. By major component is meant at least 50%, preferably at least 65%, more preferably at least 75%, especially at least 85% by weight of base stock.

The base stock may also comprise as a minor component, preferably less than 30%, more preferably less than 20%, especially less than 10% by weight of base stock of any or a mixture of Group III+, IV and/or Group V base stocks which have not been used as the major component in the base stock. Examples of such Group V base stocks include alkyl naphthalenes, alkyl aromatics, vegetable oils, esters, for example monoesters, diesters and polyol esters, polycarbonates, silicone oils and polyalkylene glycols. More than one type of Group V base stock may be present. Preferred Group V base stocks are esters, particularly polyol esters.

For engine oils, the friction reducing additive may be present at levels of at least 0.2 wt %, preferably at least 0.3 wt %, more preferably at least 0.5 wt % based on the total weight of the engine oil. The friction reducing additive may be present at levels of up to 5 wt %, preferably up to 3 wt %, more preferably up to 2 wt % based on the total weight of the engine oil.

The automotive engine oil may also comprise other types of additives of known functionality at levels between 0.1 to 30 wt %, more preferably between 0.5 to 20 wt %, yet more preferably between 1 to 10 wt % based on the total weight of the engine oil. These further additives can include detergents, dispersants, oxidation inhibitors, corrosion inhibitors, rust inhibitors, anti-wear additives, foam depressants, pour point depressants, viscosity index improvers and mixtures thereof. Viscosity index improvers may include polyisobutenes, polymethacrylate acid esters, polyacrylate acid esters, diene polymers, polyalkyl styrenes, alkenyl aryl conjugated diene copolymers and polyolefins. Foam depressants may include silicones and organic polymers. Pour point depressants may include polymethacrylates, polyacrylates, polyacrylamides, condensation products of haloparaffin waxes and aromatic compounds, vinyl carboxylate polymers, terpolymers of dialkylfumarates, vinyl esters of fatty acids and alkyl vinyl ethers. Ashless detergents may include carboxylic dispersants, amine dispersants, Mannich dispersants and polymeric dispersants. Antiwear additives may include ZDDP, ashless and ash containing organic phosphorous and organo-sulphur compounds, boron compounds, and organo-molybdenum compounds. Ash-containing dispersants may include neutral and basic alkaline earth metal salts of an acidic organic compound. Oxidation inhibitors may include hindered phenols and alkyl diphenylamines. Additives may include more than one functionality in a single additive.

For an engine oil, the base stock may range from SAE viscosity grade 0 W to 15 W. The viscosity index is preferably at least 90 and more preferably at least 105. The base stock preferably has a viscosity at 100° C. of 3 to 10 $mm^2/s$, more preferably 4 to 8 $mm^2/s$. The Noack volatility, measured according to ASTM D-5800 is preferably less than 20%, more preferably less than 15%.

The lubricant composition of the present invention may be used as a gear oil. The gear oil may be an industrial, automotive and/or marine gear oil. When the lubricant composition is a gear oil, the friction reducing additive is preferably present in the range between 0.1 to 10 wt % based on the total weight of the gear oil.

For gear oils, the friction reducing additive may be present at levels of at least 0.2 wt %, preferably at least 0.3 wt %, more preferably at least 0.5 wt % based on the total weight of the gear oil. The friction reducing additive may be present at levels of up to 5 wt %, preferably up to 3 wt %, more preferably up to 2 wt % based on the total weight of the gear oil.

The gear oil may have a kinematic viscosity according to an ISO grade. An ISO grade specifies the mid-point kinematic viscosity of a sample at 40° C. in cSt ($mm^2/s$). For example, ISO 100 has a viscosity of 100±10 cSt and ISO 1000 has a viscosity of 1000±100 cSt. The gear oil preferably has a viscosity in the range from ISO 10 to ISO 1500, more preferably ISO 68 to ISO 680.

Gear oils according to the invention preferably have good low temperature properties. For example, the viscosity of such formulations at −35° C. is less than 120,000 centapoise (cP), more preferably less than 100,000 cP, especially less than 90,000 cP.

Industrial gear oils include those suitable for use in gear boxes with spur, helical, bevel, hypoid, planetary and worm gears. Suitable applications include use in mining; mills such as paper, textile and sugar mills; steel production and in wind turbines. One preferred application is in wind turbines where the gear boxes typically have planetary gears.

In a wind turbine, the gear-box is typically placed between the rotor of a wind turbine blade assembly and the rotor of a generator. The gear-box may connect a low-speed shaft turned by the wind turbine blade(s) rotor at about 10 to 30 rotations per minute (rpm), to one or more high speed shafts that drive the generator at about 1000 to 2000 rpm, the rotational speed required by most generators to produce electricity. The high torque exerted in the gear-box can generate huge stress on the gears and bearings in the wind turbine. A gear oil of the present invention may enhance the fatigue life of the gear-box of a wind turbines by reducing the friction between the gears.

Lubricants in wind turbines gearboxes are often subjected to prolonged periods of use between maintenance, i.e. long service intervals. Therefore a long lasting lubricant composition with high stability may be required, so as to provide suitable performance over lengthy durations of time.

Automotive gear oils include those suitable for use in manual transmissions, transfer cases and differentials which all typically use a hypoid gear. By transfer case we mean a part of a four wheel drive system found in four wheel drive and all wheel drive systems. It is connected to the transmission and also to the front and rear axles by means of driveshafts. It is also referred to in the literature as a transfer gearcase, transfer gearbox, transfer box or jockey box.

Marine thruster gearboxes have specific gear oils that include a higher proportion of additives, e.g. dispersants, anticorrosives, to deal with corrosion and water entrainment compared to industrial and automotive gear oils. There are also outboard gear oils used for the propeller unit which may be more relevant for smaller vessels.

A gear oil according to the invention may comprise one or more of the further additives described herein. The gear oil preferably comprises one or more additive(s) which may include at least one species of extreme-pressure agent selected from the group consisting of sulfur-based additives and phosphorus-based additives, or at least one species of the extreme-pressure agents and at least one species of additive selected from the group consisting of solubilizing agent, ashless dispersant, pour point depressant, antifoaming agent, antioxidant, rust inhibitor, and corrosion inhibitor.

Other additives may be present in the gear oils of known functionality at levels between 0.01 to 30 wt %, more preferably between 0.01 to 20 wt % more especially between 0.01 to 10 wt % based on the total weight of the gear oil. These can include detergents, extreme pressure/antiwear additives, dispersants, corrosion inhibitors, rust inhibitors, friction modifiers, foam depressants, pour point depressants, and mixtures thereof. Extreme pressure/antiwear additives include ZDDP, tricresyl phosphate, amine phosphates. Corrosion inhibitors include sarcosine derivatives, for example Crodasinic O available from Croda Europe Ltd. Foam depressants include silicones and organic polymers. Pour point depressants include polymethacrylates, polyacrylates, polyacrylamides, condensation products of haloparaffin waxes and aromatic compounds, vinyl carboxylate polymers, terpolymers of dialkylfumarates, vinyl esters of fatty acids and alkyl vinyl ethers. Ashless detergents include carboxylic dispersants, amine dispersants, Mannich dispersants and polymeric dispersants. Friction modifiers include amides, amines and partial fatty acid esters of polyhydric alcohols. Ash-containing dispersants include neutral and basic alkaline earth metal salts of an acidic organic compound. Additives may have more than one functionality in a single material.

The gear oil may further comprise an antioxidant preferably in the range 0.2 to 2 wt %, more preferably 0.4 to 1 wt % by weight based on the total weight of the gear oil. Antioxidants include hindered phenols, alkyl diphenylamines and derivatives and phenyl alpha naphthylamines and derivatives of. Gear oil compositions with the presence of the antioxidant preferably exhibit a percentage viscosity loss, measured using a modified version of CEC L-40-A-93, over a 100 hour period of less than 20%, more preferably less than 15% and especially less than 10%.

The gear oil preferably comprises at least 0.05 wt %, more preferably at least 0.5 wt %, particularly at least 1 wt %, and especially at least 1.5 wt % of further additive(s) (additive pack) based upon the total weight of the gear oil. The gear oil preferably comprises up to 15 wt %, more preferably up to 10 wt %, particularly up to 4 wt %, and especially up to 2.5 wt % of further additive(s) (additive pack) based upon the total weight of the gear oil.

Suitable commercially available additive packs for industrial gear oils include Hitec 307 (for wind turbines), 315, 317 and 350 (ex Afton); Irgalube ML 605 A (ex BASF); Lubrizol IG93MA, 506, 5064 and 5091 (ex Lubrizol); Vanlube 0902 (ex Vanderbilt); RC 9330, 9410 and 9451 (ex Rhein Chemie); NA-LUBE BL-1208 (ex King Industries).

One use of the gear oil is in a wind turbine gear box. A gear box is typically placed between the rotor of a wind turbine blade assembly and the rotor of a generator. The gear box may connect a low-speed shaft turned by the wind turbine blade(s) rotor at about 10 to 30 rotations per minute (rpm), to one or more high speed shafts that drive the generator at about 1000 to 2000 rpm, the rotational speed required by most generators to produce electricity. The high torque exerted in the gear-box can generate huge stress on the gears and bearings in the wind turbine. A gear oil described herein may enhance the fatigue life of the gear box of a wind turbine by reducing the friction between the gears.

Gear oils in wind turbine gear boxes are often subjected to prolonged periods of use between maintenance, i.e. long service intervals. Therefore a long lasting gear oil with high stability may be required, so as to provide suitable performance over lengthy durations of time.

The lubricant composition of the present invention may be used as a hydraulic oil or fluid. When the lubricant composition is a hydraulic oil or fluid, the friction reducing additive is suitably present in the range from 0.1 to 10 wt % based on the total weight of the hydraulic fluid.

For hydraulic fluids, the friction reducing additive may be present at levels of at least 0.2 wt %, preferably at least 0.3 wt %, more preferably at least 0.5 wt % based on the total weight of the hydraulic fluid. The friction reducing additive may be present at levels of up to 5 wt %, preferably up to 3 wt %, more preferably up to 2 wt % based on the total weight of the hydraulic fluid.

The hydraulic fluid may have a viscosity from ISO 10 to ISO 100, preferably from ISO 32 to ISO 68.

Hydraulic fluids find use wherever there is a need to transfer pressure from one point to another in a system. Some of the many commercial applications where hydraulic fluids are utilized are in aircraft, braking systems, compressors, machine tools, presses, draw benches, jacks, elevators, die-castings, plastic moldings, welding, coal-mining, tube reducing machines, paper-machine press rolls, calendar stacks, metal working operations, fork lifts, and automobiles.

A hydraulic oil or fluid according to the invention may comprise one or more of the further additives described herein.

The lubricant composition of the present invention may be used as a metalworking fluid. When the lubricant composition is a metal working fluid, the friction reducing additive is preferably present in the range between 1 to 20 wt % based on the total weight of the metal working fluid.

For metal working fluids, the friction reducing additive may be present at levels of at least 2 wt %, preferably at least 3 wt %, more preferably at least 5 wt % based on the total weight of the metal working fluid. The friction reducing additive may be present at levels of up to 15 wt %, preferably up to 10 wt % based on the total weight of the metal working fluid.

The metal working fluid may have a viscosity of at least ISO 10, preferably at least ISO 100.

Metalworking operations include for example, rolling, forging, hot-pressing, blanking, bending, stamping, drawing, cutting, punching, spinning and the like and generally employ a lubricant to facilitate the operation. Metalworking fluids generally improve these operations in that they can provide films of controlled friction or slip between interacting metal surfaces and thereby reduce the overall power required for the operations, and prevent sticking and decrease wear of dies, cutting bits and the like. Sometimes the lubricant is expected to help transfer heat away from a particular metalworking contact point.

Metal working fluids often comprise a carrier fluid and one or more additives. The carrier fluid imparts some general lubricity to the metal surface and carries/delivers the specialty additives to the metal surfaces. Additionally, the metal working fluid may provide a residual film on the metal part thereby adding a desired property to the metal being processed. The additives can impart a variety of properties including friction reduction beyond hydrodynamic film lubrication, metal corrosion protection, extreme pressure or anti-wear effects. The carrier fluid may be a base stock.

Carrier fluids include various petroleum distillates including American Petroleum Institute Group I to V base stocks. The additives can exist within the carrier fluid in a variety of forms including as dissolved, dispersed in, and partially soluble materials. Some of the metal working fluid may be lost to or deposited on the metal surface during the working process; or may be lost to the environment as spillage, sprays, etc; and may be recyclable if the carrier fluid and additives have not degraded significantly during use. Due to entry of a percentage of the metal working fluid into process goods and industrial process streams, it is desirable if the components to the metal working fluid are eventually biodegradable and pose little risk of bioaccumulation to the environment The metalworking fluid may comprise up to 90 wt % of base stock, more preferably up to 80 wt % based on the total weight of the metal working fluid.

A metalworking fluid according to the invention may comprise one or more of the further additives described herein. The metalworking fluid may comprise at least 10 wt % of further additives based on the total weight of the metal working fluid.

The lubricant composition of the present invention may comprise friction reducing agents other than those defined herein such as esters, partial esters, phosphonates, organomolybdenum-based compounds, fatty acids, higher alcohols, fatty acid esters, sulfur containing esters, phosphate esters, acid phosphoric acid esters, and amine salts of phosphoric acid esters.

In one preferred embodiment, the lubricant composition according to the present invention comprises only friction reducing agents which are compounds of Formula (I). Thus, one preferred lubricant composition consists essentially of, or consists of, friction reducing agents which are compounds of Formula (I) defined herein.

The compounds of Formula (I) may reduce the coefficient of friction of a lubricant composition, particularly when measured using a mini-traction machine (MTM), when compared to an equivalent lubricant composition comprising no friction reducing additive. The coefficient of friction may be a kinetic coefficient of friction.

The compounds of Formula (I) defined herein may be capable of reducing the coefficient of friction of a lubricant composition, preferably an engine oil, when compared to an equivalent composition comprising no friction reducing additive, by at least 15%, preferably by at least 30%, more preferably by at least 40%, particularly by at least 45%, and especially by at least 50% when using a mini-traction machine, in the test described herein, preferably using Group II mineral oil, at a temperature of 100° C., load of 1.0 GPa and a speed of rotation of 0.02 m/s.

The coefficient of friction may be reduced, as described herein, over the temperature range 0 to 200° C., preferably over the range 20 to 180° C., more preferably over the range 40 to 150° C.

The coefficient of friction may be reduced, as described herein, when measured at a speed of rotation of 0.002 m/s, 0.02 m/s, 0.2 m/s and/or at 2 m/s.

The invention has been illustrated by the following non-limiting examples.

The following test procedure was used.

Mini-Traction Machine (MTM)

The coefficient of friction of a lubricant composition (control composition with no friction-reducing additive) containing 100 wt % of Group II mineral oil (Pure Performance 110N, Phillips 66 company) was determined at 40° C., 100° C. and 150° C. using a MTM with a ¾ inch ball on a smooth disc. The measurements were repeated using the control composition above containing an additional 0.5 wt % of the friction reducing additive being evaluated (test composition).

The MTM was supplied by PCS Instruments of London, UK. This machine provides a method for measuring the coefficient of friction of a given lubricant using a ball-on-disc configuration whilst varying several properties such as speed, load and temperature. The MTM is a computer controlled precision traction measurement system whose test specimens and configuration have been designed such that realistic pressures, temperatures and speeds can be attained without requiring large loads, motors or structures. The disc was AISI 52100 hardened bearing steel with a mirror finish (Ra<0.01 μm) and the ball was AISI 52100 hardened bearing steel. The load applied was 36 N (1 GPa contact pressure) and the speed of rotation was varied from 0.001 m/s to 2 m/s. Approximately 50 ml of the lubricant composition was then added. The ball was loaded against the face of the disc and the ball and disc were driven independently to create a mixed rolling/sliding contact with a slide-roll ratio of 50%. The frictional force between the ball and disc was measured by a force transducer. Additional sensors measured the applied load and lubricant temperature.

EXAMPLES

Example 1

100 g of sorbitol and 0.1 g of NaOH (0.007% by wt) were added to a pressurized stainless-steel reactor. The reaction mixture was heated with vigorous mixing to 120° C. 1,222 g of ethylene oxide was then added in portions and allowed to react, so that the total pressure of the gases did not exceed 35 psi. After addition of the last portion of the ethylene oxide, the reaction mixture was heated to 150° C. and stirred at this temperature for two additional hours to complete the ethoxylation reaction.

453 g of ethoxylated sorbitol (produced above), 997 g of poly(12-hydroxystearic acid) and 0.3 g of tin oxalate catalyst were mixed together and heated to 230° C. Vacuum and slight nitrogen sparge (0.1 cfm) were applied, and the reaction was carried out until the acid number of the mixture was below 2 mgKOH/g. The reaction was then cooled to 80-90° C., and 4 g phosphoric acid (75 wt %) was added in order to neutralize the catalyst. The product was then filtered to remove solid impurities. If required, a deodorization process was performed by applying live steam to the product at 125-135° C. for about 2 hours. The final product had a saponification value of 143 mgKOH/g, an acid value of 1.1 mgKOH/g, an iodine value of 1.7 gl/100 g, a hydroxyl value of 25.4 mgKOH/g, and a viscosity of 22,000 Cp at 20° C.

Example 2

The procedure of Example 1 was repeated except that 293 g of ethylene oxide and 185 g of the resultant ethoxylated sorbitol were used. The final product had a saponification value of 143 mgKOH/g, an acid value of 1.4 mgKOH/g, an iodine value of 1.7 gl/100 g, and a hydroxyl value of 25.4 mgKOH/g.

Example 3

The procedure of Example 1 was repeated except that 997 g of 12-hydroxystearic acid was used instead of poly(12-hydroxystearic acid). The final product had a saponification value of 143 mgKOH/g, an acid value of 1.6 mgKOH/g, an iodine value of 1.7 gl/100 g, and hydroxyl value of 26.1 mgKOH/g.

Example 4

The friction reducing additives (FRA) produced in Examples 1 to 3 were evaluated using the MTM test procedure described above and the results for Group H mineral oil are shown in Tables 2 to 4.

TABLE 2

Coefficient of Friction at 40° C.

| | | Test Composition | | |
|---|---|---|---|---|
| Speed (m/s) | Control Composition | +0.5 wt % of FRA of Example 1 | +0.5 wt % of FRA of Example 2 | +0.5 wt % of FRA of Example 3 |
| 0.002 | 0.100 | 0.060 | 0.092 | 0.037 |
| 0.020 | 0.070 | 0.057 | 0.073 | 0.520 |
| 0.200 | 0.060 | 0.059 | 0.063 | 0.570 |
| 2.000 | 0.052 | 0.053 | 0.054 | 0.540 |

TABLE 3

Coefficient of Friction at 100° C.

| | | Test Composition | | |
|---|---|---|---|---|
| Speed (m/s) | Control Composition | +0.5 wt % of FRA of Example 1 | +0.5 wt % of FRA of Example 2 | +0.5 wt % of FRA of Example 3 |
| 0.002 | 0.104 | 0.044 | 0.101 | 0.065 |
| 0.020 | 0.081 | 0.042 | 0.087 | 0.061 |

TABLE 3-continued

Coefficient of Friction at 100° C.

| | | Test Composition | | |
|---|---|---|---|---|
| Speed (m/s) | Control Composition | +0.5 wt % of FRA of Example 1 | +0.5 wt % of FRA of Example 2 | +0.5 wt % of FRA of Example 3 |
| 0.200 | 0.054 | 0.039 | 0.058 | 0.054 |
| 2.000 | 0.040 | 0.037 | 0.041 | 0.041 |

TABLE 4

Coefficient of Friction at 150° C.

| | | Test Composition | | |
|---|---|---|---|---|
| Speed (m/s) | Control Composition | +0.5 wt % of FRA of Example 1 | +0.5 wt % of FRA of Example 2 | +0.5 wt % of FRA of Example 3 |
| 0.002 | 0.106 | 0.016 | 0.099 | 0.070 |
| 0.020 | 0.079 | 0.018 | 0.079 | 0.057 |
| 0.200 | 0.041 | 0.021 | 0.041 | 0.038 |
| 2.000 | 0.020 | 0.016 | 0.019 | 0.020 |

Example 5

The friction reducing additives (FRA) produced in Examples 1 to 3 were evaluated using the MTM test procedure described above except that a commercially available conventional automotive engine oil (GF-5 approved, viscosity grade 10W-30) was used at 135° C., instead of Group II mineral oil. The results are shown in Table 5.

TABLE 5

Coefficient of Friction at 135° C.

| | | Test Composition | | |
|---|---|---|---|---|
| Speed (m/s) | Control Composition | +0.5 wt % of FRA of Example 1 | +0.5 wt % of FRA of Example 2 | +0.5 wt % of FRA of Example 3 |
| 0.002 | 0.132 | 0.095 | 0.116 | 0.106 |
| 0.020 | 0.141 | 0.094 | 0.114 | 0.086 |
| 0.200 | 0.109 | 0.072 | 0.105 | 0.071 |
| 2.000 | 0.042 | 0.032 | 0.047 | 0.061 |

Example 6

The friction reducing additive (FRA) produced in Example 1 was evaluated for its performance as an additive in a metal working fluid. A Microtap II thread tapping machine supplied by Microtap USA, Inc. is used to measure the tapping torque of metal working fluids. The Microtap II machine cuts threads in pre-drilled holes at a selected set of operating parameters. Tests were performed on 50 mm×200 mm×8 mm mild steel bars containing 3.7 mm diameter holes. They were supplied by the company Robert Speck Ltd.

For this Example, the following parameters were used:

1 ml of metal working fluid is added to the Microtap II machine using a pipette

Ambient temperature
6.0 mm depth of hole
4 mm forming tap
Maximum torque set at 220 Ncm
Cutting speed 1000 rpm After applying the metal working fluid, the holes were threaded and the amount of torque required was recorded. If the metal working fluid isn't adequate to allow the thread to be formed within the set maximum torque of 220 Ncm then multiple attempts are made by the machine and then declared as a fail. The results are given in Table 6 below.

TABLE 6

Micro Tap Test Results

| Metal Working Fluid | Control Composition of ISO 22 S/N 100 Group 1 Mineral Oil | Control Composition + 2 wt % of FRA of Example 1 |
|---|---|---|
| Torque required (Ncm) | 220-FAIL | 156 |

The above examples illustrate the improved properties of a lubricant composition according to the present invention.

The invention claimed is:

1. A lubricant composition comprising a base stock and at least 0.10 wt % of a friction reducing additive which comprises a compound of Formula (I):

$$R^1[(AO)_n—R^2]_m \quad (I)$$

wherein:

$R^1$ is a residue of a monosaccharide or a disaccharide;
m is 4 to 10;
AO is an alkylene oxide residue, where A is —($C_rH_{2r}O$)— and r is 2, 3 or 4;
each n is independently from 2 to 20;
each $R^2$ is independently H or $R^3$, where each $R^3$ is independently a residue of a polyhydroxyalkyl or polyhydroxyalkenyl carboxylic acid, a residue of a hydroxyalkyl or hydroxyalkenyl carboxylic acid and/or a residue of an oligomer of the hydroxyalkyl or hydroxyalkenyl carboxylic acid; and
on average at least 0.5 of $R^2$ groups are $R^3$,
wherein the lubricant composition is non-aqueous,
wherein the product of indices n×m is 10 to 100, and
wherein the friction reducing additive has a molecular weight (Mn) between 3,000 to 10,000, and is capable of reducing a coefficient of friction of the lubricant composition by at least 20% when measured using a mini-traction machine (MTM).

2. The lubricant composition according to claim 1 wherein $R^1$ is a residue of a monosaccharide selected from the group consisting of glucose, fructose and sorbitol or a residue of a disaccharide selected from the group consisting of maltose, palitose, lactitol and lactose.

3. The lubricant composition according to claim 1 wherein m is 5 to 6.

4. The lubricant composition according to claim 1 wherein n×m is 25 to 100.

5. The lubricant composition according to claim 1 wherein at least 2.0 of the $R^2$ groups are $R^3$.

6. The lubricant composition according to claim 1 wherein $R^3$ is a residue of a polyhydroxyalkyl carboxylic acid.

7. The lubricant composition according to claim 6 wherein the number of hydroxyalkyl monomers in the polyhydroxyalkyl carboxylic acid residue is 3 to 10.

8. The lubricant composition according to claim 1 wherein at least 2.0 of the $R^2$ groups are H.

9. The lubricant composition according to claim 1 wherein the friction reducing additive is an ethoxylated sorbitol ester of a polyhydroxyalkyl carboxylic acid.

10. The lubricant composition according to claim 1 wherein the base stock is selected from the group consisting of an API Group I, II, III, IV, V base oil or mixtures thereof.

11. The lubricant composition according to claim 1 wherein the lubricant composition is a gear oil.

12. The lubricant composition according to claim 1 wherein the lubricant composition is an engine oil.

13. An engine comprising the lubricant composition according to claim 12.

14. A method of reducing friction in an automotive engine which comprises using an engine oil comprising a base stock and at least 0.01 wt % of a friction reducing additive which comprises a compound of the Formula (I):

$$R^1[(AO)_n—R^2]_m \quad (I)$$

wherein:

$R^1$ is a residue of a monosaccharide or a disaccharide;
m is 4 to 10;
AO is an alkylene oxide residue, where A is —($C_rH_{2r}O$)— and r is 2, 3 or 4;
each n is independently from 2 to 20; and
each $R^2$ is independently H or $R^3$, where each $R^3$ is independently a residue of a polyhydroxyalkyl or polyhydroxyalkenyl carboxylic acid, a residue of a hydroxyalkyl or hydroxyalkenyl carboxylic acid and/or a residue of an oligomer of the hydroxyalkyl or hydroxyalkenyl carboxylic acid; and
on average at least 0.5 of $R^2$ groups are $R^3$,
wherein the engine oil is non-aqueous,
wherein the product of indices n×m, is 10 to 100, and
wherein the friction reducing additive has a molecular weight (Mn) between 3,000 to 10,000, and is capable of reducing a coefficient of friction of the lubricant composition by at least 20% when measured using a mini-traction machine (MTM).

15. The lubricant composition according to claim 1 wherein the residue of a polyhydroxyalkyl or polyhydroxyalkenyl carboxylic acid, the residue of a hydroxyalkyl or hydroxyalkenyl carboxylic acid and/or the residue of an oligomer of the hydroxyalkyl or hydroxyalkenyl carboxylic acid is derived from a hydroxyalkyl or hydroxyalkenyl carboxylic acid of formula HO—X—COOH where X is a divalent saturated or unsaturated aliphatic radical containing 8 to 20 carbon atoms.

16. The method according to claim 14 wherein the residue of a polyhydroxyalkyl or polyhydroxyalkenyl carboxylic acid, the residue of a hydroxyalkyl or hydroxyalkenyl carboxylic acid and/or the residue of an oligomer of the hydroxyalkyl or hydroxyalkenyl carboxylic acid is derived from a hydroxyalkyl or hydroxyalkenyl carboxylic acid of formula HO—X—COOH where X is a divalent saturated or unsaturated aliphatic radical containing 8 to 20 carbon atoms.

17. The lubricant composition according to claim 1, where $R^1$ is a residue of a monosaccharide selected from the group consisting of glucose, fructose and sorbitol.

18. The method according to claim 14, where $R^1$ is a residue of a monosaccharide selected from the group consisting of glucose, fructose and sorbitol.

19. The lubricant composition according to claim 1, where r is 2.

20. The method according to claim 14, where r is 2.

* * * * *